US009702659B2

(12) United States Patent
Bowman

(10) Patent No.: US 9,702,659 B2
(45) Date of Patent: Jul. 11, 2017

(54) CONCEALED HOLSTER ASSEMBLY

(71) Applicant: Jeffrey R. Bowman, Mount Holly, NJ (US)

(72) Inventor: Jeffrey R. Bowman, Mount Holly, NJ (US)

( * ) Notice: Subject to any disclaimer, the term of this patent is extended or adjusted under 35 U.S.C. 154(b) by 0 days.

(21) Appl. No.: 14/730,397

(22) Filed: Jun. 4, 2015

(65) Prior Publication Data

US 2016/0061563 A1 Mar. 3, 2016

Related U.S. Application Data

(63) Continuation-in-part of application No. 14/470,210, filed on Aug. 27, 2014.

(51) Int. Cl.

| | |
|---|---|
| ***F41C 33/00*** | (2006.01) |
| ***F41C 33/02*** | (2006.01) |
| *F41C 33/04* | (2006.01) |

(52) U.S. Cl.

CPC ..... *F41C 33/0209* (2013.01); *F41C 33/041* (2013.01); *F41C 33/048* (2013.01)

(58) Field of Classification Search

CPC .. F41C 33/046; F41C 33/048; Y10S 224/911; Y10S 224/912; Y10T 24/2708; Y10T 24/2532; A44D 2205/00; B65D 33/2508; B65D 33/2591; A44B 19/16

USPC .... 224/222, 238, 243, 587, 911–912; 2/247, 2/249–251, 254

See application file for complete search history.

(56) References Cited

U.S. PATENT DOCUMENTS

| | | | | |
|---|---|---|---|---|
| 3,923,214 | A | 12/1975 | Kippen | |
| D248,866 | S | 8/1978 | Gonzales | |
| 4,290,148 | A * | 9/1981 | Roberts | A41D 13/1209 2/51 |
| 4,398,655 | A | 8/1983 | Perry | |
| 4,579,265 | A | 4/1986 | Schiller | |
| 5,058,788 | A | 10/1991 | Newmark | |
| 5,073,988 | A * | 12/1991 | Lewis, Jr. | A41D 19/0041 2/123 |
| 5,092,472 | A * | 3/1992 | Jones | A42B 1/002 211/30 |
| 5,215,238 | A | 6/1993 | Baruch | |
| 5,233,380 | A * | 8/1993 | Marvy | G03B 17/32 294/150 |
| D361,656 | S | 8/1995 | Fogarty, Jr. | |
| 5,588,571 | A | 12/1996 | Mazzo | |
| 5,704,070 | A * | 1/1998 | Stogner | A42C 5/04 2/175.1 |
| 5,909,834 | A | 6/1999 | Parrott, III | |
| 5,943,698 | A | 8/1999 | Blanks, I | |
| 6,264,079 | B1 | 7/2001 | Skaggs | |
| D512,561 | S * | 12/2005 | Cook | D3/222 |

(Continued)

FOREIGN PATENT DOCUMENTS

| | | | |
|---|---|---|---|
| CN | 102538586 | A | 7/2012 |
| EP | 1869997 | A2 | 12/2007 |

*Primary Examiner* — Nathan J Newhouse
*Assistant Examiner* — Scott McNurlen
(74) *Attorney, Agent, or Firm* — Fox Rothschild LLP

(57) ABSTRACT

A holster assembly including a holster defining a receiving cavity and a strap extending between first and second ends. The first end of the strap is connected to the holster and the second end of the strap is adjustably connectable relative to the holster. The strap is manufactured from an elastic material.

11 Claims, 8 Drawing Sheets

(56) References Cited

U.S. PATENT DOCUMENTS

| | | | | |
|---|---|---|---|---|
| 7,631,368 | B1 | 12/2009 | Samson | |
| 8,702,177 | B1 * | 4/2014 | Hogue | A61F 5/3769 297/484 |
| 2003/0029897 | A1 | 2/2003 | Beletsky et al. | |
| 2005/0017034 | A1 | 1/2005 | Ausanio | |
| 2005/0211739 | A1 | 9/2005 | Bayless | |
| 2006/0237918 | A1 | 10/2006 | Satorius | |
| 2009/0057357 | A1 | 3/2009 | Rohrbach | |
| 2010/0108728 | A1 | 5/2010 | Castaneda | |
| 2012/0117713 | A1 | 5/2012 | Hoffner | |
| 2012/0198595 | A1 | 8/2012 | Young | |
| 2012/0305615 | A1 * | 12/2012 | Craighead | F41C 33/048 224/587 |
| 2014/0014695 | A1 | 1/2014 | Gyorfi | |
| 2014/0014699 | A1 | 1/2014 | Larko | |

* cited by examiner

CONCEALED HOLSTER ASSEMBLY

This application is a continuation-in-part of U.S. application Ser. No. 14/470,210, filed on Aug. 27, 2014, the contents of which are incorporated herein.

FIELD OF THE INVENTION

This invention relates to a concealed holster assembly. More particularly, the invention relates to a concealed holster assembly configured for securing a firearm, magazine, handcuffs and the like.

BACKGROUND OF THE INVENTION

There are many situations when a police officer, other law enforcement officer or the like may have need for a backup firearm. One scenario occurs when the officer is subjected to a "gun grab", wherein an individual physically grabs the officer and then tries to take the officer's primary gun from the officer's hip holster. As the officer and the individual wrestle for the primary gun, the officer typically utilizes their dominant hand to block the individual's access to the primary gun. During the altercation, the individual may be on top of the officer or otherwise limiting the officer's movement. If the officer has easy access to a backup firearm with their off hand, they will have a better chance of safely resolving the situation.

Unfortunately, officers do not have an adequate means to carry a backup firearm, and therefore, many officers do not carry a backup firearm. Those that do are limited to carry a small caliber gun, typically on their ankle "Ankle carry" is largely ineffective in many situations where a backup firearm would most likely be used, for example, the scenario described above. If the individual is on top of the officer or otherwise restricting the movement of the officer, it is very difficult for the officer to quickly reach an ankle carried backup gun, particularly with their non-dominant hand.

Such ineffectiveness often causes an officer not to carry a back-up firearm.

Additionally, the law enforcement officer may also require additional items, such as handcuffs or magazines, whether backup or primary, that need to be retained in a concealed manner.

SUMMARY OF THE INVENTION

In at least one aspect, the present invention provides a holster system that allows an officer to carry a back-up gun which is readily accessed by their off hand, stays in place during rigorous physical activity, and is both "comfortable" and "comforting."

In at least one embodiment, the invention provides a holster assembly including a holster defining a receiving cavity and a strap extending between first and second ends. The first end of the strap is connected to the holster and the second end of the strap is adjustably connectable relative to the holster. The strap is manufactured from an elastic material.

In at least one embodiment, the invention provides a garment having a pocket with a passage therethrough and a holster assembly including a holster defining a receiving cavity and a strap extending between first and second ends. The first end of the strap is connected to the holster and the second end of the strap is adjustably connectable relative to the holster. The strap is manufactured from an elastic material. In at least one embodiment the passage is a sealable passage.

In at least one embodiment, the invention provides a holster assembly including a holster pad having a front surface and a rear surface; a receiving cavity secured to the front surface of the holster pad; and a connector assembly extending along at least a portion of the rear surface of the holster pad, the connector assembly configured for secured engagement with a complementary connector assembly in a concealed location.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
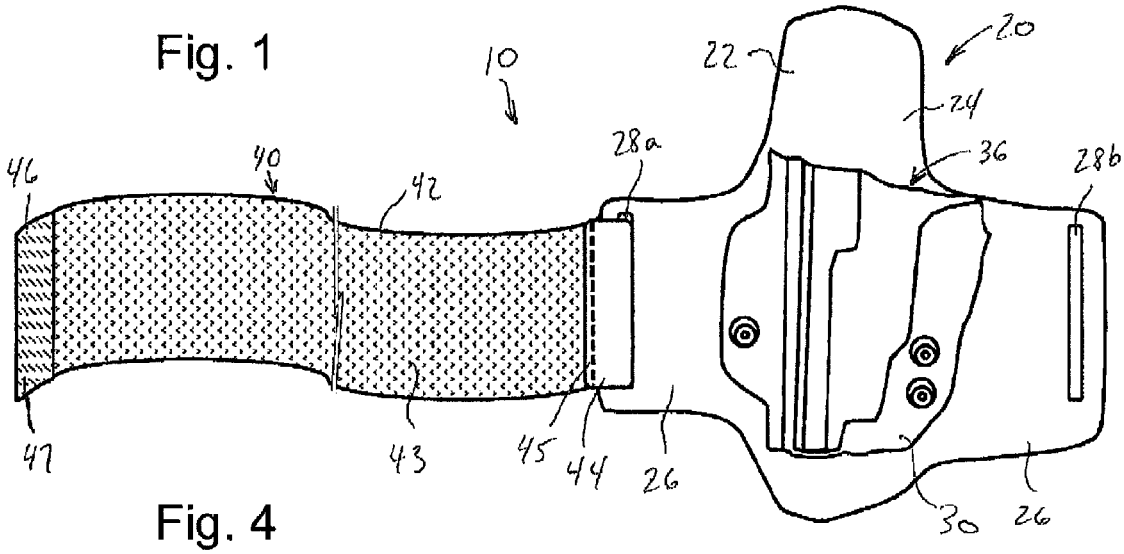
FIG. 1 is a front elevation view of an exemplary holster assembly in accordance with an embodiment of the invention in a preattached condition.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Referring to FIGS. 1-4, an exemplary holster assembly 10 in accordance with an embodiment of the invention will be described. The holster assembly 10 generally comprises a holster 20 and a securing strap 40. With reference to FIGS.

2 and 3, the exemplary holster 20 includes a flexible backing pad 22 with a main pad section 24 and opposed extensions 26. The backing pad 22 may be manufactured from any natural or synthetic flexible material such that it may shape to the user's leg 12 when attached thereto, but has sufficient tensile strength that it does not substantially deform under the tension of the strap 40 when attached to the user. An exemplary material is leather. In the illustrated embodiment, the back surface 23 of the pad 22 has a gel pocket 25 which provides added comfort to the user.

A holster shell 30 is attached to the front surface 21 of the pad 22 via screws 34 or the like as is known in the art. The shell 30 has a contoured body 32 such that a firearm receiving pocket 36 is defined between the shell body 32 and the backing pad 22. The shell body 32 can have various configurations corresponding to different firearms and may include portions to ensure the firearm remains in the holster 20 even during significant activity of the user.

In the illustrated embodiment, the shell 30 is manufactured from a rigid material, for example, Kydex™. The shell 30 is preferably constructed of the thin material to allow for best concealment. The shell 30 may be made from other rigid and non-rigid materials. With a rigid configuration, the holster 20 allows for easy re-holstering of the firearm, for example, re-holstering after leaving a secure building which requires the removal of all firearms. This may be particularly advantageous since the holster assembly 10 will be concealed and not amenable to visual re-holstering.

Figure 12:
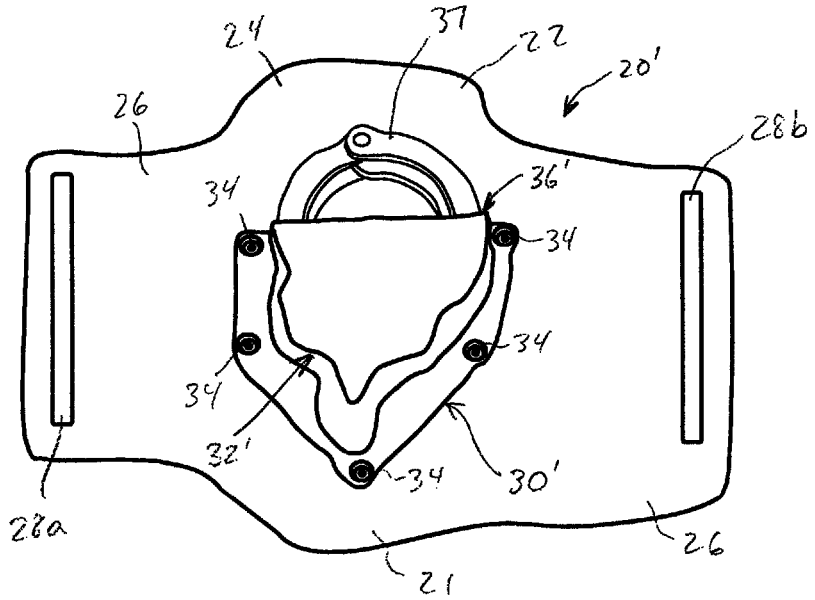
FIG. 12 is front elevation view of another exemplary holster utilized in an exemplary embodiment of the invention.
Figure 13:
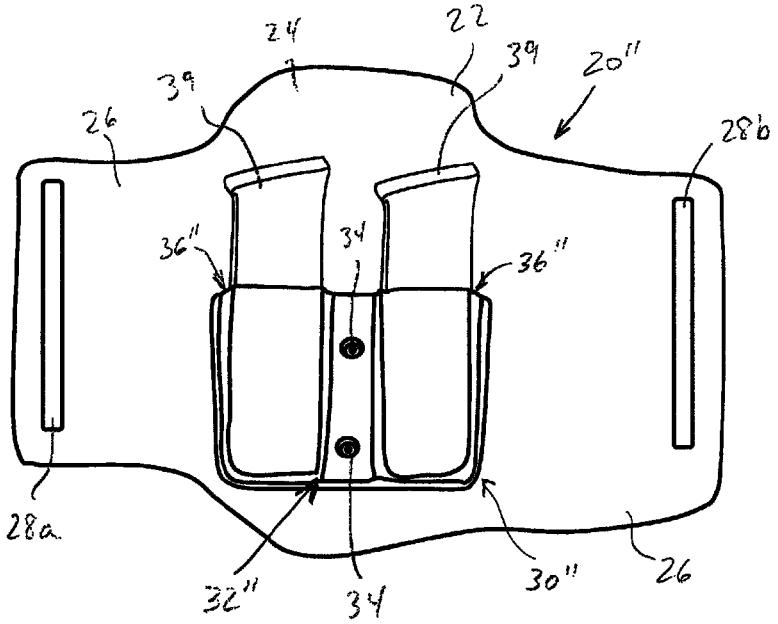
FIG. 13 is front elevation view of another exemplary holster utilized in an exemplary embodiment of the invention.

Referring to FIGS. 12 and 13, exemplary holsters 20' and 20" will be described. The front of the holster 20' illustrated in FIG. 12 is substantially the same as in the previous embodiment except that the holster shell 30' has a contoured body 32' such that a handcuff receiving pocket 36' is defined between the shell body 32' and the backing pad 22 to receive handcuffs 37. The front of the holster 20" illustrated in FIG. 13 is substantially the same as in the previous embodiments except that the holster shell 30" has a contoured body 32" such that a pair of magazine receiving pockets 36" are defined between the shell body 32" and the backing pad 22 to receive ammunition magazines 39. The receiving pockets 36, 36', 36" may configured to receive any firearms and other accessories. The illustrated firearms, handcuffs and magazines are for illustration purposes only. Furthermore, one or more holsters 20, 20', 20" may be attached to a single strap 40 via the slots 28*a*, 28*b*.

Figure 14:
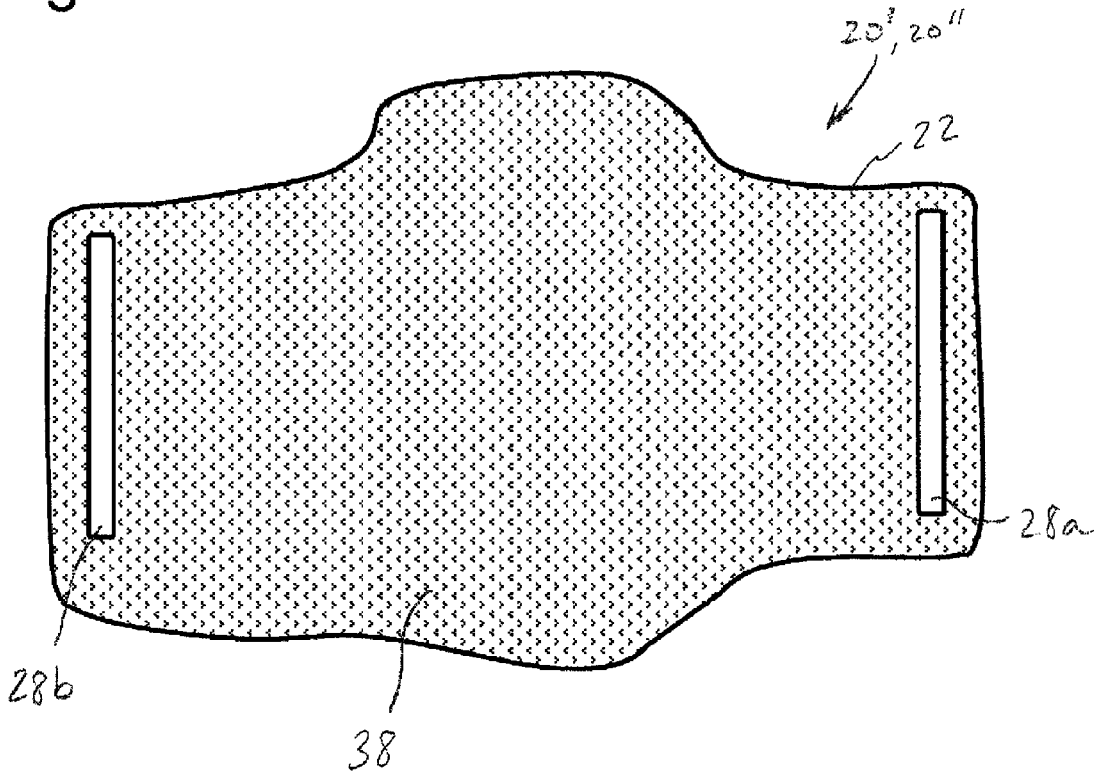
FIG. 14 is a rear elevation view of the holster of FIG. 12 or FIG. 13.

Alternatively, as illustrated in FIG. 14, a rear surface of the holster 20', 20" may be provided with a connector assembly 38 for securing the holster 20', 20" in another concealed location. For example, the connector assembly 38 may have a hook and loop configuration whereby the holster 20', 20" may be secured to complementary hook and loop fastener on a bullet proof vest. The connector assembly is not limited to hook and loop fasteners, but may be other forms of fasteners, for example, snaps, clips or the like. Similarly, the holster 20', 20" is not limited to concealment on the bullet proof vest, but may be secured in other concealed locations.

In the illustrated embodiments, each of the extensions 26 defines a respective slot 28*a*, 28*b* for attachment of the securing strap 40. The strap 40 has a body 42 extending between opposed ends 44 and 46 with a length greater than its width. The length may be any desired length such that the strap 40 is sufficiently long to wrap around the user's thigh. The width may be any desired width, but is preferably of a relatively significant width, for example, 5 inches, to provide good weight distribution of the holstered firearm and comfort to the wearer.

Figure 4:
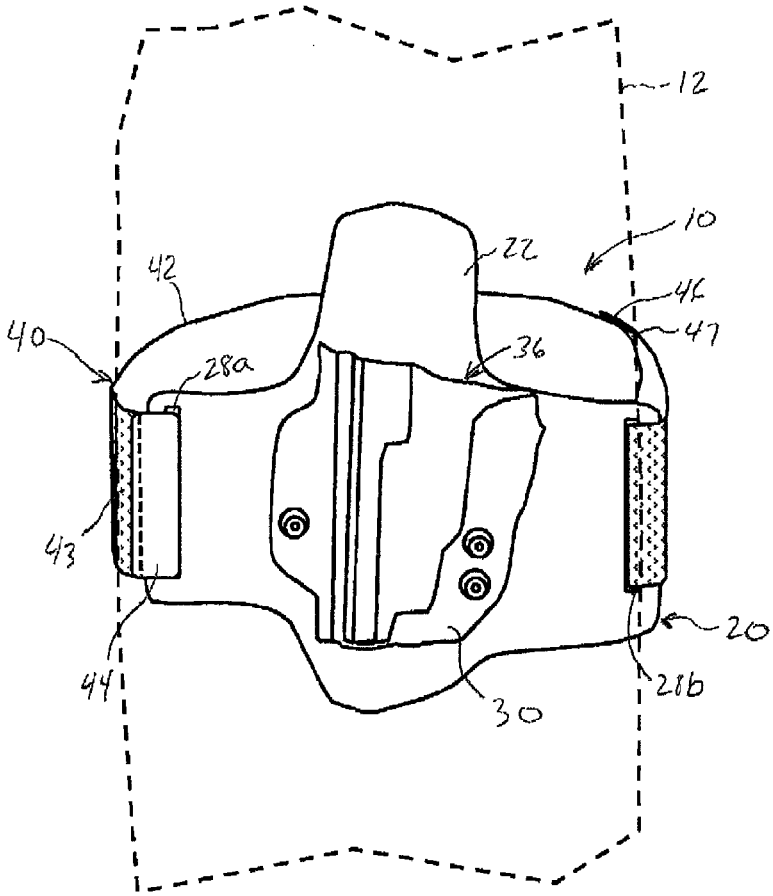
FIG. 4 is a perspective view of the holster assembly of FIG. 1 in an attached condition.
Figure 2:
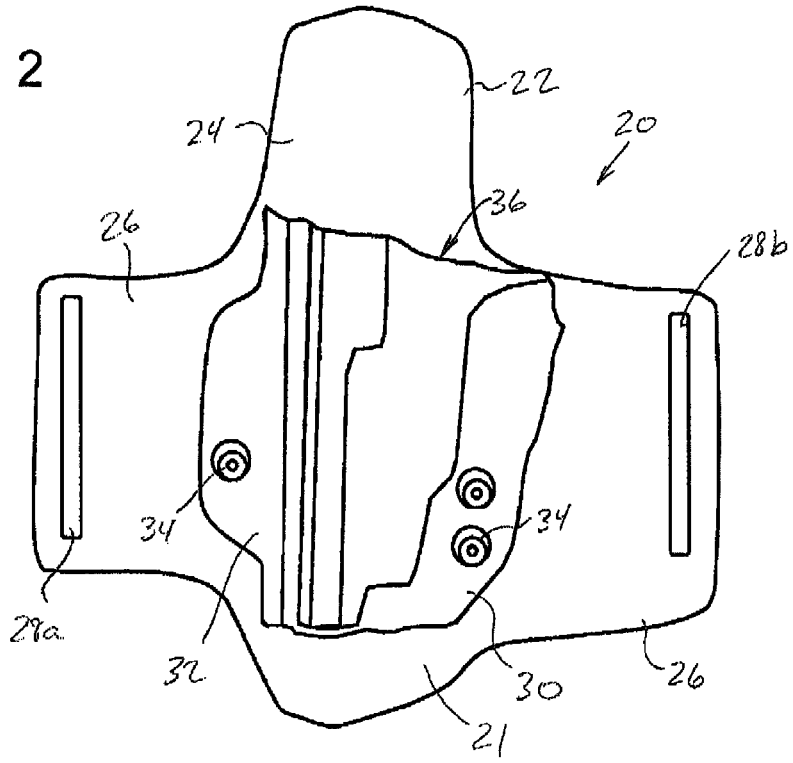
FIG. 2 is front elevation view of an exemplary holster utilized in an exemplary embodiment of the invention.
Figure 3:
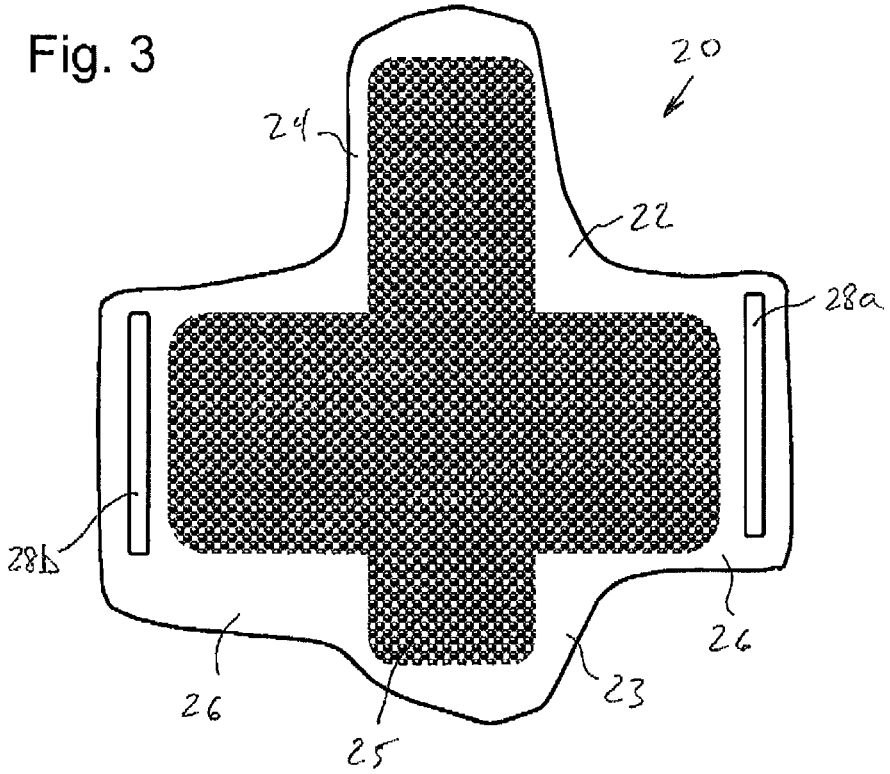
FIG. 3 is a rear elevation view of the exemplary holster of FIG. 2.

In the illustrated embodiment, one end 44 of the strap 40 is permanently connected to the holster 20 by extending through the slot 28*a* and stitched upon itself at 45. Other permanent and non-permanent methods may be utilized for attaching the end 44 of the strap to the holster 20. The opposite end 46 of the strap 40 is configured to be adjustably connected to the holster 20 via the other slot 26*a*. With reference to FIG. 4, the holster pad 22 is positioned against the user's leg 12 and the strap free end 46 is extended around the leg and through the slot 28*b*. The free end 46 is then folded back against and attached to the strap body 42. In the illustrated embodiment, the outside surface of the strap body 42 has a series of loops 43 while the free end 46 has a series of hooks 47. The hooks 47 engage the loops 43 to secure the free end 46 of the strap 40 to the strap body 42 to secure the holster assembly 10 on the user's leg 12. While the illustrated embodiment shows loops 43 along substantially the entire length of the body 42, such is not required and the loops may be provided only in designated areas. It is also understood that the hooks and loops may be reversed and that other removably securable fasteners may be utilized, for example, hook and eyes or reuseable adhesive. Additionally, while the illustrated strap 40 generally does not cover the holster pad 22 or shell 30, the strap 40 may be otherwise routed such that it extends across the holster shell 30, for example, to further retain the firearm and/or cover the holster 20 to reduce the chance of the shell or firearm "printing" through the user's clothes, ie an outline showing through the clothes.

To ensure a secure, stable attachment of the holster assembly 10, the strap body 42 is made from an elastic material such that the strap 40 may pulled tight about the user's leg before securing the free end 46. The elastic tensile force of the strap 40 will cause the strap 40 to compress about the user's leg. The adjustable nature of the strap 40 allows the user to find a tension/compression that is comfortable for the user while maintaining the holster 20 in a stable position.

In a preferred embodiment, the strap body 42 is manufactured from a blend of polychloroprene and spandex, however, other materials may be utilized. The spandex provides the desired elasticity. The polychloroprene causes the strap body 42 to have a tackiness which helps prevent the holster assembly 10 from slipping down the leg of the user and it also helps to disperse perspiration which adds to comfort and helps reduce potential rusting of the firearm.

Figure 5:
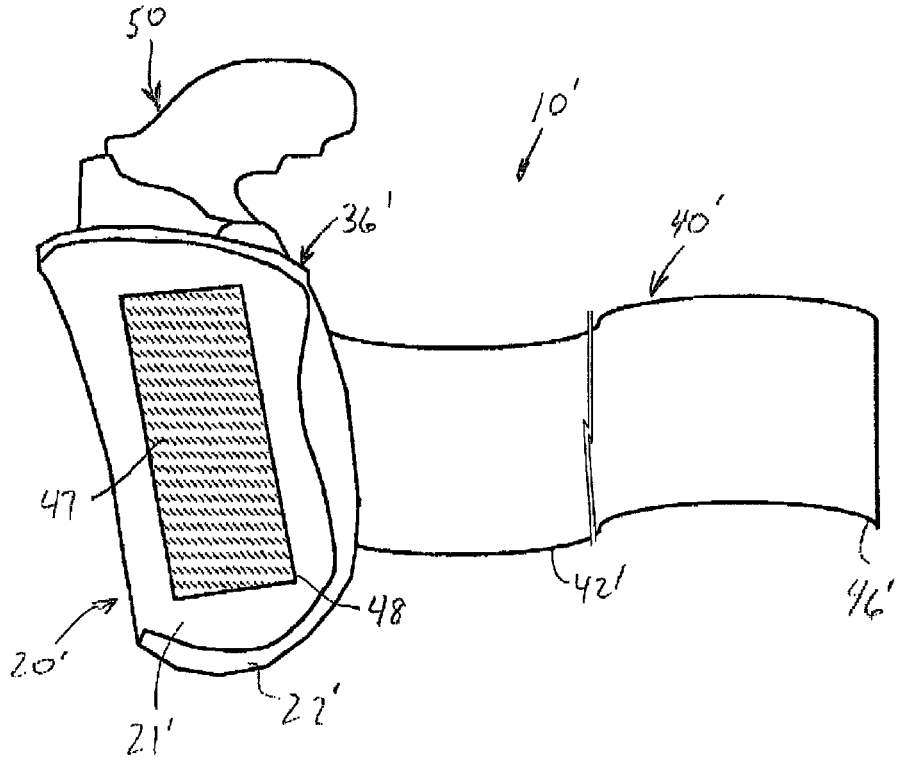
FIG. 5 is a front elevation view of another exemplary holster assembly in accordance with an embodiment of the invention in a preattached condition.
Figure 6:
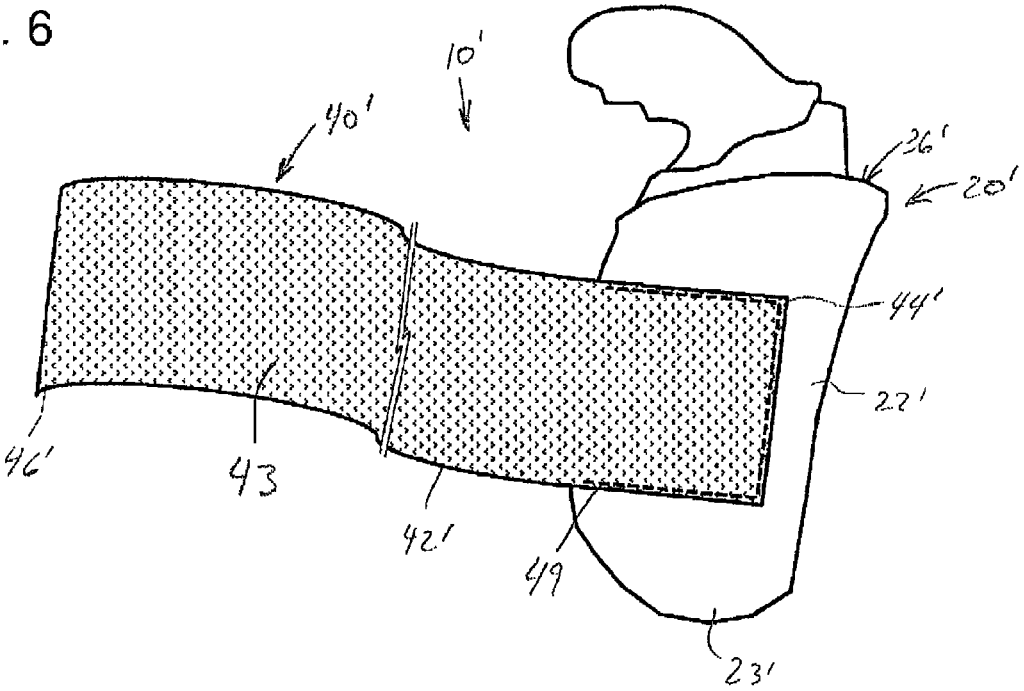
FIG. 6 is a rear elevation view of the holster assembly of FIG. 5.

Referring to FIGS. 5 and 6, an alternative holster assembly 10' in accordance with an embodiment of the invention will be described. The holster assembly 10' is similar to the previous embodiment and only the differences will be described. The holster assembly 10' includes a soft shell holster 20' which is defined by a flexible pad 22' that has a front portion 21' folded upon a rear portion 23' and secured thereto, for example via stitching (not shown), to define the firearm receiving pocket 36'. The holster 20' may be manufactured from, for example, leather.

The holster 20' does not include extensions as in the previous embodiment. Instead, the first end 44' of the strap body 42' is secured directly to the rear portion 23' of the holster 20' via stitching 49 or the like. To secure the free end 46' of the strap 40', an attachment pad 48 is provided on the front portion 21'. The inward facing surface of the strap body 42' includes a series of loops 43 while the attachment pad 48 includes complimentary hooks 47. To secure the holster assembly 10', the holster 20' is positioned against the user's leg and the strap 40' is wrapped around the leg and the loops 43 of the body 42' connected to the hooks 47 of the attachment pad 48. The strap 40' again is made from an elastic material such that it may be tensioned and secured to provide a compressed fit about the user's leg. The strap 40' may also be wrapped such that it covers a portion of the firearm 50, to help maintain the firearm 50 in the holster receiving pocket 36'.

Figure 7:
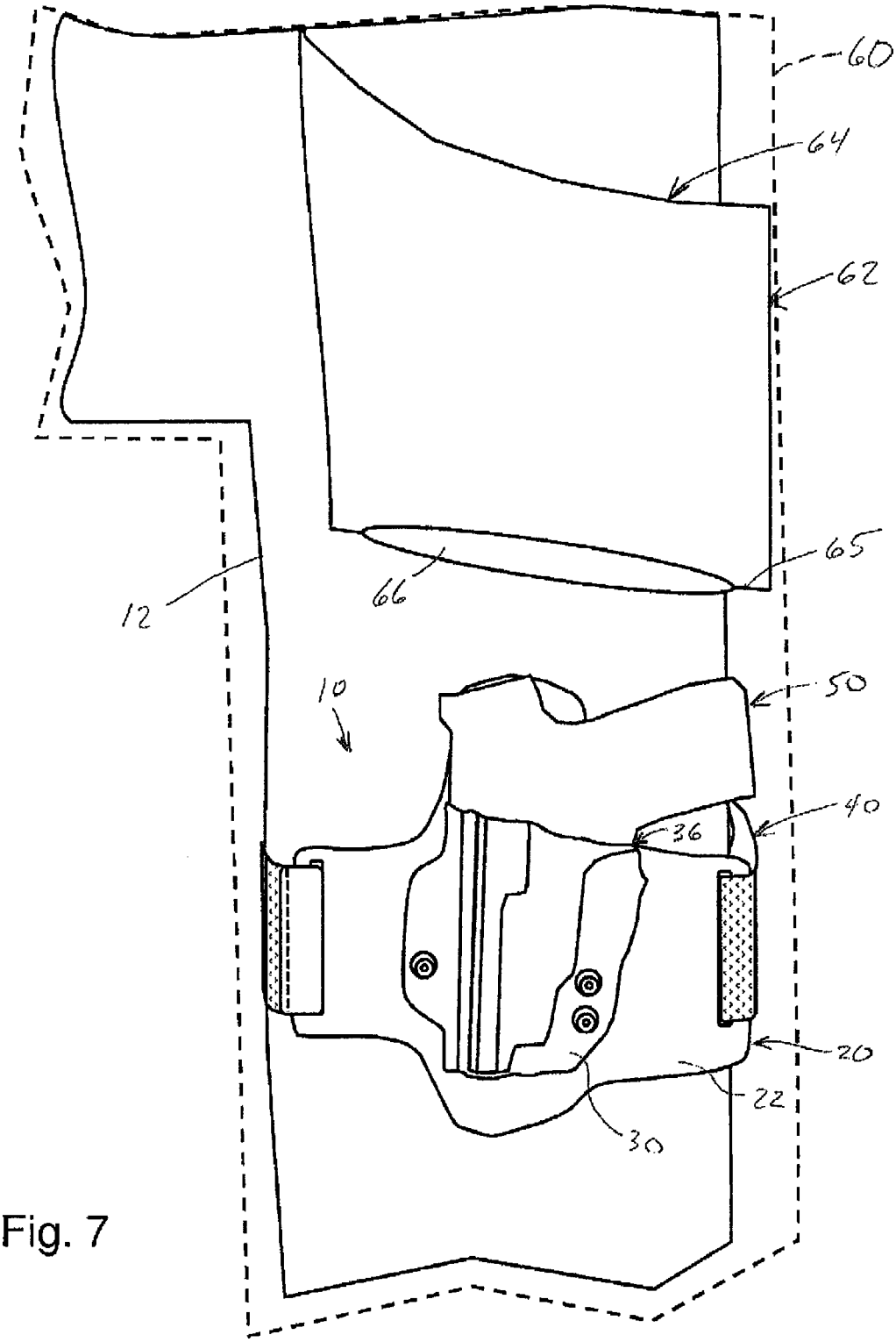
FIG. 7 is an isometric view of the holster assembly of FIG. 1 in use.

Referring to FIG. 7, a preferred method of use of the holster assemblies 10, 10' of the present invention will be described. The holster assembly 10 is secured to the user's leg 12 such that the firearm 50 is aligned with a pocket 62 of the user's pants 60. While pants are described herein, it is understood that the garment may take other forms, for example, shorts, jeans, trousers, etc. The pocket 62 will have a standard upper opening 64 such that the user may extend their hand into the pocket 62. An inner portion 65 of the pocket 62 will define a passage 66 which is sufficiently large to allow the user to reach through the passage, grab the firearm 50 from the holster 20 and remove their hand with the firearm 50 positioned therein. As described hereinafter, it is preferable that the passage 66 is a sealable passage; however, it is contemplated that the user's pocket 62 can be manufactured with a permanent passage 66.

Figure 8:
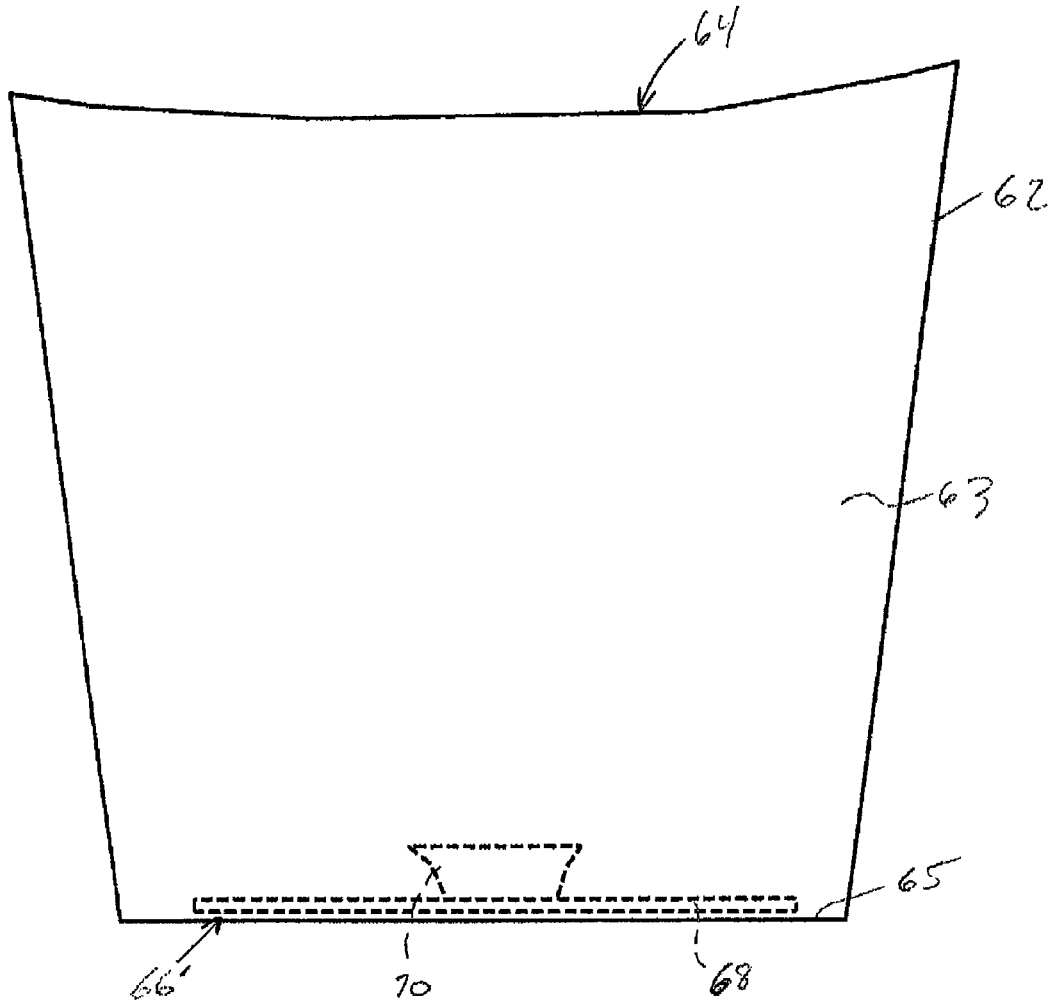
FIG. 8 is an elevation view of an exemplary sealable passage within a pocket in accordance with an embodiment of the invention.
Figure 9:
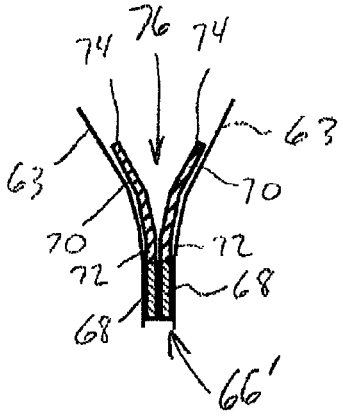
FIG. 9 is a cross-sectional view along the line 9-9 in FIG. 8.

Referring to FIGS. 8 and 9, an exemplary sealable passage 66' which is formed integrally within a pocket 62 will be described. The pocket 62 is formed by opposed sidewalls 63 which are secured in a standard manner to define the pocket 62 with a standard opening 64. The sealable passage 66' is formed along an inner portion 65 of the pocket 62. The sealable passage 66' is preferably along a lower most portion of the pocket 62, but may be otherwise positioned. The sealable passage 66' includes a pair of opposed connectors 68, with each connector secured to a respective wall 63 of the pocket 62. The connectors 68 may have various configurations, for example, complementary magnets, complementary hook and loop fasteners, or complementary plastic zipper seals. The connectors 68 are preferably strong enough to support the weight of common items in the pocket 62, e.g. a set of house keys, loose change and paper money, but no so strong to inhibit the immediate access to the firearm 50.

To allow the user to easily separate the connectors 68 and reach through the passage 66', each connector preferably has an engaging member 70 extending therefrom into the pocket 62. In the illustrated embodiment, each engaging member 70 extends from a connection end 72 and tapers outward to a free end 74 such that a tapered groove 76 is defined between the two engaging members 70. To open the sealable passage 66', the user urges their fingers (not shown) into the tapered groove 76 such that the engaging members 70, and thereby the connectors 68, are urged apart. After the firearm 50 has been removed, the connectors 68 can be reconnected such that the pocket 62 resumes its normal functionality. The sealable passage 66' is not limited to the configuration illustrated herein. For example, more or fewer than two engaging members may be utilized. Additionally, as described above, the location of the sealable passage may be otherwise provided, for example, at a midpoint along one wall 63 of the pocket 62. In such an embodiment, the connectors 68 would both be connected to the same wall 63, but still separate to define the passage. Other modifications may also be incorporated without departing from the spirit of the invention.

Figure 10:
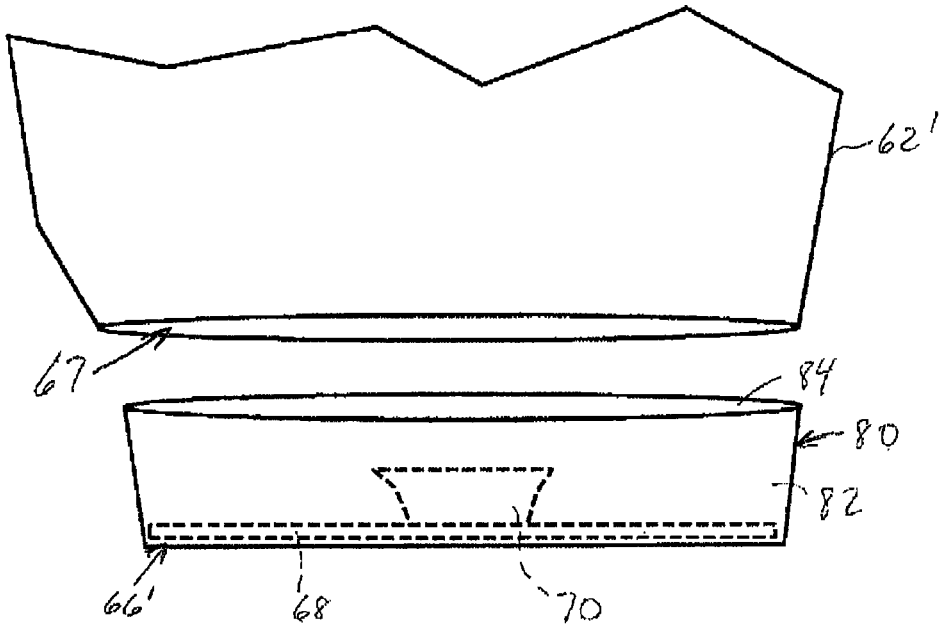
FIGS. 10 and 11 are elevation views illustrating an exemplary retro-fit sealable passage kit in a non-assembled and assembled condition, respectively.
Figure 11:
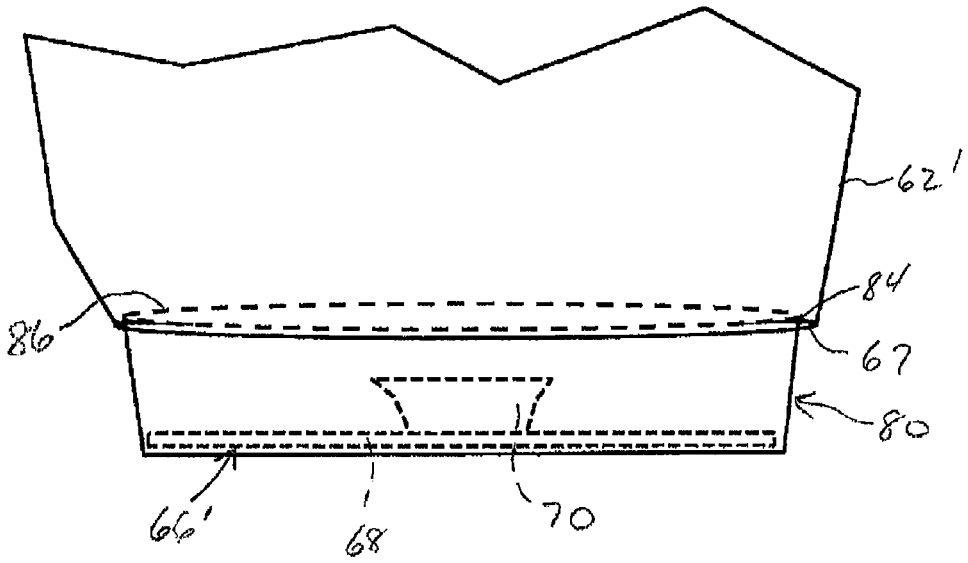

Referring to FIGS. 10 and 11, an exemplary retro-fit sealable passage kit 80 in accordance with an embodiment of the invention will be described. The kit 80 allows an officer to retro-fit existing garments to include a sealable passage 66'. The kit 80 includes a side wall 82 with an open end 84 and a sealable passage 66', similar to that described above, extending between the opposed side walls 82 opposite the open end 84. To retro-fit an existing pocket 62', a hole 67 is created in a desired area of the pocket 62' and the kit 80 is positioned such that the open end 84 of the wall 82 is within the hole 67, or alternatively, the hole 67 of the pocket 62' is positioned within the open end 84 of the kit 80 and then the wall 82 is secured to the pocket 62', for example, via stitching 86 or the like. It is also contemplated that the side wall 82 may have a length substantially equal to the length of the existing pocket 62', whereby the pocket 62' is retro-fit by removing the pocket 62' in its substantial entirety and replacing it with the kit 80.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A system for providing selective access to a concealed item, the system comprising:

a holster defining at least one receiving cavity, the at least one receiving cavity configured to receive at least one item therein;

at least one strap coupled to the holster, wherein the at least one strap is configured to secure the holster on a user's body; and a sealable passage kit for use with a garment pocket of the user to enable selective access to the at least one item received in the holster; the sealable passage kit comprising:

a pair of opposed sidewalls;

an open end on a first end of the kit, wherein the open end is configured to be secured to a hole in the garment pocket; and a sealable passage formed at a second end of the kit, wherein the sealable passage comprises a pair of opposed connectors, each of the opposed connectors comprising an engaging member extending therefrom to aid in separation of the pair of opposed connectors when fingers of a human hand are urged on the engaging members, and further wherein each engaging member tapers outward from a connection end adjacent the opposed connector to a free end opposite the connection end such that the engaging members define a tapered groove when the sealable passage is closed.

2. The system of claim 1, wherein the opposed connectors comprise at least one of complementary magnets, complementary hook-and-loop fasteners, and complementary plastic zipper seals.

3. The system of claim 1, wherein the at least one strap is configured to secure the holster to the user's leg.

4. The system of claim 1, wherein the at least one item comprises at least one of one or more firearms, one or more handcuffs, and one or more ammunition magazines.

5. The system of claim 1, wherein the open end of the sealable passage kit is secured to a hole located along at least one wall of the garment pocket.

6. A garment pocket configured for selective access to a concealed item, the garment pocket comprising:

a pair of opposed sidewalls;

an opening formed between the pair of opposed sidewalls, the opening sized to allow a human hand to pass therethrough;

a sealable passage formed within at least one of the opposed sidewalls, wherein the sealable passage comprises a pair of opposed connectors; and a pair of engaging members extending from respective opposed connectors to aid in separation of the pair of opposed connectors when fingers of the human hand are urged on the engaging members, wherein each engaging member tapers outward from a connection end adjacent the respective opposed connectors to a free end opposite the connection end such that the pair of engaging members define a tapered groove when the sealable passage is closed.

7. The garment pocket of claim 6, wherein the opposed connectors comprise at least one of complementary magnets, complementary hook-and-loop fasteners, and complementary plastic zipper seals.

8. The garment pocket of claim 6, wherein the garment pocket is located in a user's pants.

9. A retro-fit sealable passage kit for use with a garment pocket, the sealable passage kit comprising:

a pair of opposed sidewalls;

an open end on a first end of the kit, wherein the open end is configured to be secured to a hole in the garment pocket;

a sealable passage formed at a second end of the kit, the sealable passage comprising a pair of opposed connectors; and at least one engaging member extending from at least one opposed connector to aid in separation of the pair of opposed connectors when fingers of a human hand are urged on the at least one engaging member, wherein the at least one engaging member tapers outward from a connection end adjacent a respective opposed connector to a free end opposite the connection end.

10. The sealable passage kit of claim 9, wherein the open end is secured to the hole in the garment pocket with stitching.

11. The sealable passage kit of claim 9, wherein the opposed connectors comprise at least one of complementary magnets, complementary hook-and-loop fasteners, and complementary plastic zipper seals.

* * * * *